US005080557A

United States Patent [19]

Berger

[11] Patent Number: 5,080,557

[45] Date of Patent: Jan. 14, 1992

[54] TURBINE BLADE SHROUD ASSEMBLY

[75] Inventor: Jeffrey L. Berger, Indianapolis, Ind.

[73] Assignee: General Motors Corporation, Detroit, Mich.

[21] Appl. No.: 640,790

[22] Filed: Jan. 14, 1991

[51] Int. Cl.[5] ..... F01D 5/20

[52] U.S. Cl. ..... 415/173.3; 415/115; 415/116; 415/138; 277/26; 277/53; 277/79; 277/235 R

[58] Field of Search ..... 415/115-116, 415/134, 136-139, 170.1, 173.1, 173.6, 174.4, 175, 196-197, 200, 173.3; 277/26, 53, 79, 235 R

[56] References Cited

U.S. PATENT DOCUMENTS

| | | | |
|---|---|---|---|
| 3,825,364 | 7/1974 | Halila et al. | 415/116 |
| 4,109,031 | 8/1978 | Marscher . | |
| 4,209,334 | 6/1980 | Panzera | 415/174.4 |
| 4,273,824 | 6/1981 | McComas et al. | 415/200 |
| 4,289,446 | 9/1981 | Wallace . | |
| 4,318,666 | 3/1982 | Pask | 415/116 |
| 4,336,276 | 6/1982 | Bill et al. . | |
| 4,354,687 | 10/1982 | Holland et al. . | |
| 4,392,656 | 7/1983 | Triole et al. . | |
| 4,422,648 | 12/1983 | Eaton et al. . | |
| 4,551,064 | 11/1985 | Pask | 415/200 |
| 4,679,981 | 7/1987 | Guibert et al. . | |
| 4,728,257 | 3/1988 | Handschuh . | |

*Primary Examiner*—Edward K. Look
*Assistant Examiner*—Christopher M. Verdier
*Attorney, Agent, or Firm*—Saul Schwartz

[57] ABSTRACT

A turbine blade shroud assembly for a gas turbine engine includes a metal substrate ring on the engine, a continous ceramic barrier ring inside the substrate ring and exposed to hot gas in a hot gas flow path of the engine, and a wire mesh compliant ring between the barrier and substrate rings. The temperature of the barrier ring increases faster than the temperature of the substrate ring as the temperature in the hot gas flow path increases. The coefficient of thermal expansion of the substrate ring is less than the coefficient of thermal expansion of the barrier ring so that the barrier ring expands relative to the substrate ring with increasing temperature in the hot gas flow path and development of tensile hoop stress in the ceramic barrier ring is minimized.

4 Claims, 2 Drawing Sheets

TURBINE BLADE SHROUD ASSEMBLY

This invention was made under a contract or subcontract with the United States Department of Defense.

FIELD OF THE INVENTION

This invention relates to turbine blade shroud assemblies in gas turbine engines.

BACKGROUND OF THE INVENTION

In typical gas turbine engines, bypass of hot gas around turbine blades is minimized by blade shroud assemblies having metal substrate rings around the turbine blades and ceramic barrier rings bonded to the substrate rings to shield the latter from the hot gas. To avoid or minimize hoop stress in the ceramic ring due thermal growth of the substrate ring relative to the barrier ring, segmented ceramic barrier rings are common. To the same end, a blade shroud assembly has been proposed in which a metal substrate ring is shrink fitted around a continuous ceramic barrier ring. Still to the same end, another blade shroud assembly has been proposed in which a compliant cushioning ring is disposed between a continuous ceramic barrier ring and a metal substrate ring.

SUMMARY OF THE INVENTION

This invention is a new and improved gas turbine engine turbine blade shroud assembly of the type including a metal substrate ring, a continuous ceramic barrier ring inside the substrate ring, and a compliant ring between the substrate and barrier rings. In the blade shroud assembly according to this invention, the material of the substrate ring is selected to exhibit a coefficient of thermal expansion lower than that of the ceramic barrier ring throughout the operating temperature range of the engine so that the ceramic barrier ring expands relative to the substrate ring with increasing temperature.

DESCRIPTION OF A PREFERRED EMBODIMENT

Figure 1:
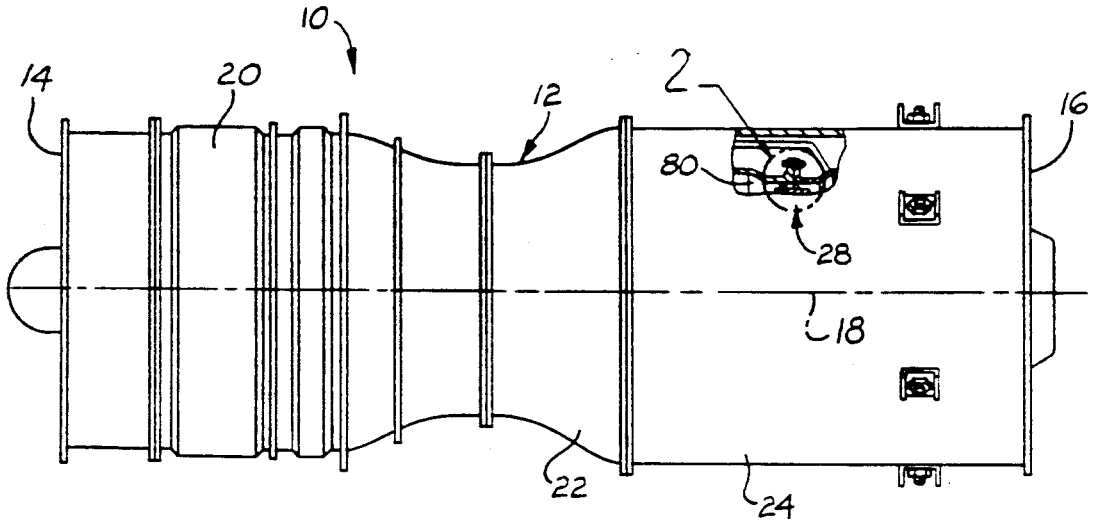
FIG. 1 is a partially broken-away side view of a gas turbine engine having a turbine blade shroud assembly according to this invention.
Figure 2:
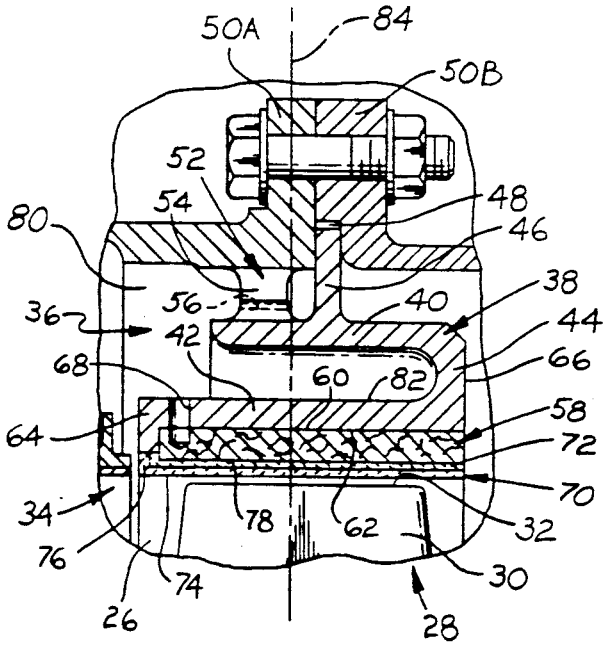
FIG. 2 is an enlarge view of a portion of FIG. 1 showing the turbine blade shroud assembly according to this invention.
Figure 3:
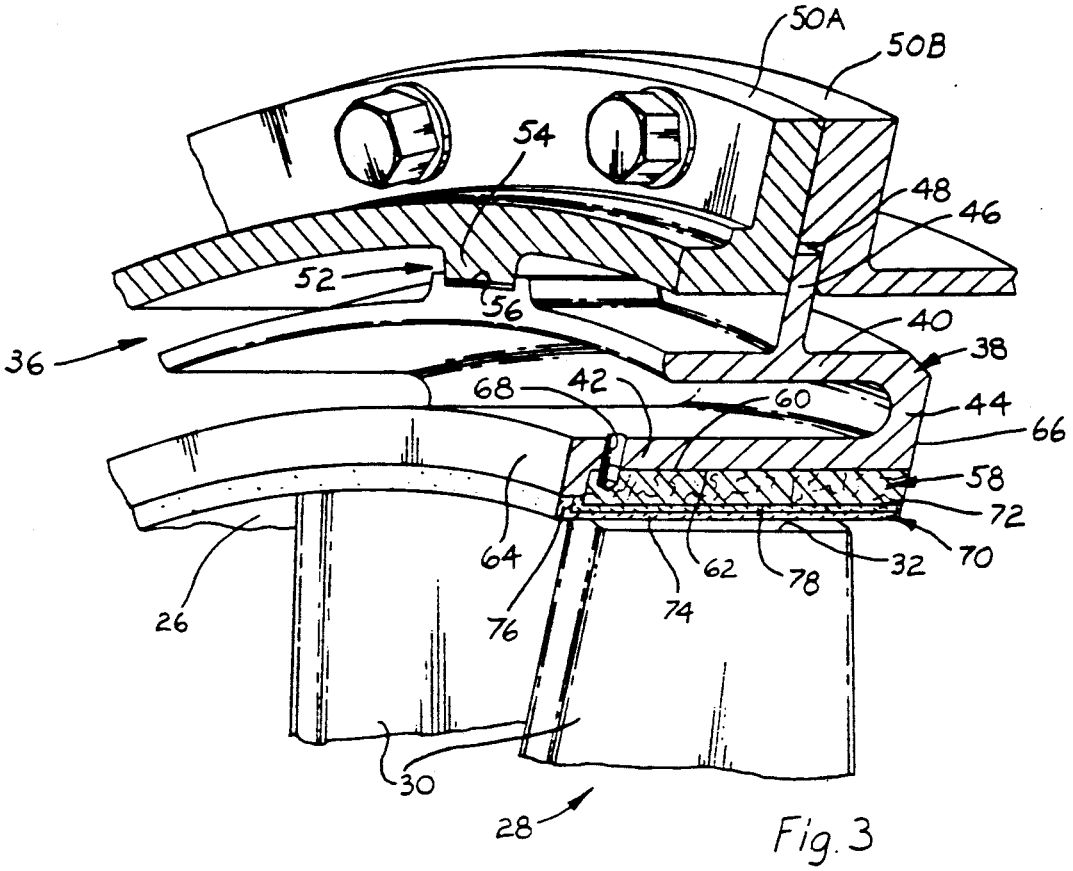
FIG. 3 is a fragmentary, broken-away perspective view of the turbine blade shroud assembly according to this invention.

Referring to FIGS. 1-3, a gas turbine engine (10) includes a case (12) having an inlet end (14), an exhaust end (16), and a longitudinal centerline (18). The case (12) has a compressor section (20), a combustor section (22), and a turbine section (24). Hot gas motive fluid generated in a combustor, not shown, in the combustor section (22) flows aft in an annular hot gas flow path (26) of the engine and expands through one or more stages of turbine blades on one or more turbine wheels supported on the case (12) for rotation about the centerline (18), only a representative stage (28) having a plurality of turbine blades (30) being shown in FIGS. 1-3.

Each blade (30) is airfoil shaped and has a flat tip 32) at the radially outermost extremity of the blade. An annular stator assembly (34) is rigidly connected to the turbine section (24) of the engine case upstream of the turbine blades (30). In the plane of the turbine blade stage (28), the turbine blade tips (32) are closely surrounded by a stationary, annular blade shroud assembly (36) according to this invention.

The blade shroud assembly (36) includes a continuous metal substrate ring (38) having a cylindrical outer leg (40), a cylindrical inner leg (42), and an integral connecting web (44). An integral radial flange (46) extends out from the outer leg (40) about midway between the ends thereof. The flange (46) is captured in a slot (48) defined between a pair of structural annular flanges (50A-B) of the engine case whereby the longitudinal position of the blade shroud assembly (36) on the case is established. The flange (46) has radial freedom in the slot (48) so that thermal growth of the substrate ring is not impeded.

The blade shroud assembly (36) is supported radially on the engine case through a plurality of conventional cross keys arrayed around the substrate ring which center the substrate ring without impeding its thermal growth, only a representative cross key (52) being illustrated in FIG. 1-3. The representative cross key (52) includes a radial lug (54) projecting inward from the structural flange (50A) of the engine case and a radial socket (56) on the outer leg (40) of the substrate ring (38) which slidably receives the lug (54).

The blade shroud assembly (36) further includes a cylindrical, metal mesh compliant ring (58) inside the substrate ring. The compliant ring has an outside wall (60) brazed to an inside cylindrical wall (62) of the inner leg (42) of the substrate ring. An annular lip (64) of the inner leg (42) overlaps the upstream end of the compliant ring. The downstream end of the compliant ring (58) is open to the hot gas flow path (26) radially inboard of an annular rear face (66) of the substrate ring. A plurality of cooling air holes are formed in the inner leg (42) near the lip (64), only a representative cooling air hole (68) being shown in FIGS. 2 and 3. Seals, not shown, may be provided between the inner leg (42) of the substrate ring and adjoining structure, such as the vane assembly (34), to minimize escape of hot gas from the flow path (26).

A ceramic barrier ring (70) of the blade shroud assembly (36) is disposed inside the compliant ring (58). The barrier ring has a cylindrical full density layer (72) adjacent the compliant ring and an integral reduced density layer (74) adjacent the blade tips (32). The barrier ring (70) has an integral lip (76) inside the lip (64) on the substrate ring and covering the inner front edge of the compliant ring (58). The ceramic barrier ring is a continuous or uninterrupted 360 degree ring which may be fabricated by spray application of liquid ceramic onto an inner wall (78) of the compliant ring to a radial depth of about 078 inches. Migration of the ceramic into the interstices in the compliant ring mechanically connects the barrier ring to the compliant ring.

In the plane of the turbine blade stage (28), the reduced density layer (74) of the barrier ring defines the outer boundary of the hot gas flow path (26) and is, therefore, directly exposed to the gas in the flow path. The temperature of the gas in the flow path (26) typically varies from ambient at engine start-up, to a maximum greater than 2500° F. in a high performance operating mode of the gas turbine engine (10).

Cooling air from the compressor of the engine is ducted at elevated pressure to an annular plenum (80), FIGS. 1-2, the aft end of which is closed by the substrate ring (38) of the blade shroud assembly (36). The cooling air circulates over both surfaces of the outer leg (40) and over an outer surface (82) of the inner leg (42). The pressure of the cooling air exceeds the pressure in the hot gas flow path behind or downstream of the turbine blade stage (28) so that a continuous flow of cooling air is induced through the cooling air holes (68) in the inner leg, through the interstices of the compliant ring (58), and into the hot gas flow path through the aft end of the compliant ring. The circulation of cooling air maintains the substrate ring (38) at a lower temperature than the compliant ring and the compliant ring at a lower temperature than the barrier ring (70).

Selection of the material for the substrate and barrier rings (38)(70) is an important feature of this invention. Specifically, the substrate and barrier ring materials are selected, respectively, to afford optimum structural integrity and thermal shielding and, in addition, to afford a thermal growth relationship characterized by expansion of the barrier ring relative to the substrate ring with increasing temperature in the operating temperature range of the engine. In a preferred embodiment, the required thermal growth relationship is achieved through material selection which yields a substrate ring having a lower coefficient or thermal expansion than the barrier ring. A preferred embodiment of the blade shroud assembly (36) is characterized by the following material selection:

(a) the substrate ring (38) is a forging of Niobium (also known as Columbium) allow FS 85 available commercially from Teledyne - Wah Chang Albany; alloy FS 85 includes about 28% Tantalum, 10.5% Tungsten, and 0.9% Zirconium;

(b) the full and reduced density layers (72-74) of the barrier ring (70) are zirconium oxide (ZrO2); and (c the compliant ring (58) is a mesh of Hoskins 875 alloy metal wires each having a diameter of about 0.0056 inches; such a ring is commercially available from Technetics under the tradename Brunsbond Pad.

Figure 4:
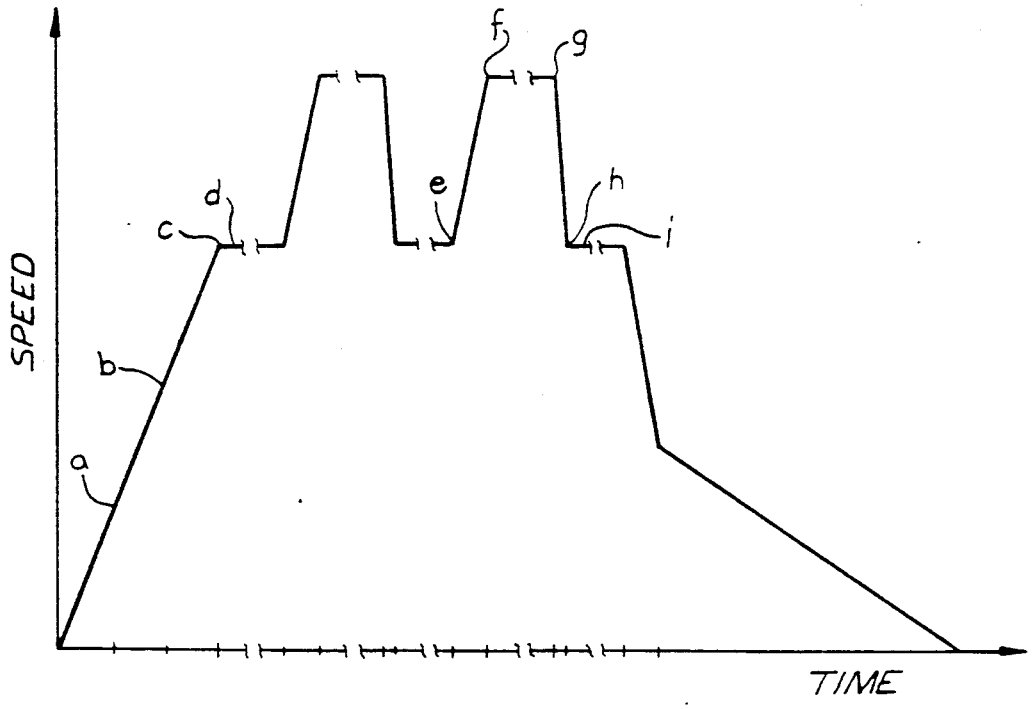
FIG. 4 is a graph depicting a gas turbine engine operating cycle during which the blade shroud assembly according to this invention may experience substantially maximum thermal growth excursions.

FIG. 4 is a graph (turbine rotor speed vs. time) illustrating an operating cycle of the gas turbine engine (10) during which the blade shroud assembly (36) may experience substantially maximum thermal growth excursions. The operating cycle depicted in FIG. 4 includes a normal acceleration from start-up to idle (points a-c) and stabilization at idle (points c-d), a first snap acceleration to and stabilization at super cruise and subsequent snap deceleration to idle (points d-e), and a second snap acceleration to and stabilization at super cruise (points e-g) and subsequent snap deceleration to idle (points g-i).

Table I below is a tabulation of data reflecting the thermal growth at the inside diameters of the barrier ring (70) and the substrate ring (38) in a plane (84), FIG. 2, perpendicular to the centerline (18) during the engine operating cycle depicted in FIG. 4. The data in Table I is for the preferred embodiment wherein the substrate ring and barrier ring are made of the materials described above, and the inside diameter of the barrier ring is 21.179 inches and the radial thickness of the barrier ring is 0.078 inches.

Referring to Table I, column 1 identifies the point in the operating cycle depicted in FIG. 4 for which the line data is applicable. Column 2 identifies the one of the substrate and barrier rings to which the line data pertains. Column 3 identifies the substrate and barrier ring temperatures at the corresponding engine operating points. Column 4 is the substrate and barrier ring coefficients of thermal expansion at the corresponding temperatures. Column 5 is the calculated thermal growth of the substrate and barrier rings at the corresponding temperatures and coefficients of thermal expansion.

TABLE I

| (1) Point in operating cycle | (2) Location in blade shroud assembly | (3) Temperature (F°.) | (4) Coefficient of thermal expansion (in/in-F°. × $10^{-3}$) | (5) Radial thermal growth (in) |
|---|---|---|---|---|
| a | substrate ring | 250 | 3.75 | .0073 |
| | barrier ring | 280 | 3.75 | .0083 |
| b | substrate ring | 455 | 4.02 | .0167 |
| | barrier ring | 695 | 4.45 | .0295 |
| c | substrate ring | 675 | 4.21 | .0276 |
| | barrier ring | 1150 | 5.10 | .0583 |
| d | substrate ring | 690 | 4.23 | .0284 |
| | barrier ring | 1240 | 5.20 | .0644 |
| e | substrate ring | 800 | 4.29 | .0339 |
| | barrier ring | 1380 | 5.30 | .0735 |
| f | substrate ring | 1330 | 4.55 | .0620 |
| | barrier ring | 3200 | 7.00 | .2320 |
| g | substrate ring | 1400 | 4.57 | .0657 |
| | barrier ring | 3200 | 7.00 | .2320 |
| h | substrate ring | 1150 | 4.48 | .0543 |
| | barrier ring | 1400 | 5.35 | .0753 |
| i | substrate ring | 1120 | 4.46 | .0525 |
| | barrier ring | 1250 | 5.20 | .0650 |

Table I demonstrates that the temperature of the substrate ring is always considerably lower than the temperature of the barrier ring except immediately after engine start-up. The data in Table I, columns 4-5, further demonstrates that throughout the operating cycle depicted in FIG. 4, the substrate ring coefficient of thermal expansion is always less than the barrier ring coefficient of thermal expansion and that the barrier ring (70) expands relative to the substrate ring (30) with increasing temperature in the operating range of the engine. Expansion of the barrier ring relative to the substrate ring with increasing temperature minimizes the likelihood of tensile hoop stresses developing in the barrier ring during thermal excursions of the blade shroud assembly.

I claim:

1. In a gas turbine engine having an annular stage of rotatable turbine blades in a hot gas flow path of said engine wherein a gas temperature varies in a range from ambient to a maximum in said engine, a turbine blade shroud assembly comprising:

a continuous ceramic barrier ring around said turbine blades having a plurality of operating temperatures increasing from ambient with increasing temperature in said hot gas flow path temperature range, a continuous metal substrate ring on a case of said gas turbine engine around said barrier ring having a plurality of operating temperatures increasing from ambient with increasing temperature in said hot gas flow path temperature range at a rate less than a rate of increase of temperature of said barrier ring for corresponding increases in temperature in said hot gas flow path temperature range and having a coefficient of thermal expansion selected with respect to a coefficient of thermal expansion of said barrier ring such that said barrier ring expands relative to said substrate ring with increasing temperature in said hot gas flow path temperature range from ambient to said maximum hot gas temperature, and a compliant ring between said barrier ring and said substrate ring having an inside surface attached to said barrier ring and an outside surface connected to said substrate ring whereby said barrier ring is connected to said substrate ring.

2. The gas turbine engine recited in claim 1 wherein said compliant ring is a metal wire mesh ring having said outside surface brazed to said metal substrate ring and said inside surface mechanically attached to said barrier ring through migration of said barrier ring ceramic into interstices of said wire mesh.

3. The gas turbine engine recited in claim 2 and further including, cooling means for maintaining said operating temperature of said substrate ring below said operating temperature of said barrier ring when the temperature in said hot gas flow path stabilizes within said hot gas flow path temperature range.

4. The gas turbine engine recited in claim 3 wherein said cooling means includes means on said engine defining a cooling air plenum exposed to said substrate ring and having pressurized cooling air therein, means on said substrate ring defining a plurality of cooling air holes for conducting cooling air from said cooling air plenum to the interstices of said wire mesh compliant ring, and means for conducting cooling air from the interstices of said wire mesh compliant ring to said hot gas flow path.

* * * * *